United States Patent [19]

Arsac

[11] 3,940,533

[45] Feb. 24, 1976

[54] METHOD OF ATTACHING METAL COMPOUNDS TO POLYMER ARTICLES

[75] Inventor: André Arsac, Millery, France

[73] Assignee: Rhone-Poulenc-Textile, France

[22] Filed: Apr. 20, 1973

[21] Appl. No.: 353,730

[30] Foreign Application Priority Data

Apr. 24, 1972 France ..... 72.14762

[52] U.S. Cl. ..... 428/225; 428/389; 428/395; 427/125; 427/301; 427/304; 427/322; 427/430

[51] Int. Cl.[2] ..... D04B 1/00; B05D 5/12

[58] Field of Search..... 117/213, 47 A, 138.8 N, 117/138.8 F, 227, 160 R, 119; 106/1; 427/125, 430, 301, 322, 304; 428/225, 389, 395

[56] References Cited

UNITED STATES PATENTS

| | | | |
|---|---|---|---|
| 3,259,559 | 7/1966 | Schnedle | 106/1 |
| 3,261,711 | 7/1966 | Sallo | 106/1 |
| 3,499,881 | 3/1970 | Poppe | 117/227 |
| 3,516,848 | 6/1970 | Foulke | 117/213 |
| 3,607,350 | 9/1971 | Rathsack | 117/47 A |
| 3,666,552 | 5/1972 | Ayukawa | 117/213 |
| 3,682,786 | 8/1972 | Brown | 117/47 A |
| 3,684,554 | 8/1972 | Donald | 117/47 A |

FOREIGN PATENTS OR APPLICATIONS

| | | | |
|---|---|---|---|
| 75,056 | 5/1894 | Germany | 117/201 |
| 508,206 | 9/1930 | Germany | 117/201 |

*Primary Examiner*—Michael F. Esposito
*Attorney, Agent, or Firm*—Stevens, Davis, Miller & Mosher

[57] ABSTRACT

A method of attaching metal compounds to articles formed from synthetic polymers wherein the articles are subjected to the action of hydrogen sulfide under pressure or to the action of an aqueous solution of a thioacetamide or thiourea, and then to the action of an aqueous solution of a silver, copper (cupric or cuprous), lead, tin or mercury salt. This method makes it possible to obtain articles, particularly textile articles, of improved electrical conductivity.

7 Claims, No Drawings

METHOD OF ATTACHING METAL COMPOUNDS TO POLYMER ARTICLES

This invention relates to a method of attaching metal compounds to articles of synthetic polymers which makes it possible to increase the electrical conductivity of these articles. The invention applies more particularly to the obtaining of antistatic textile articles such as heating floor or wall coverings, garments, articles of furnishings, and the like.

One simple method of making articles electrically conductive consists in incorporating metal wires in them. This method, however, has the drawback that only the metal wires are made conductive; as a result, if the article is used as a heating surface, the heat is not liberated at all points of the article and remains localized around the metal wires.

There is also known, in accordance with French Patent No. 644,429, a method which consists in metallizing fibrous materials in the following manner: the material is immersed in a cuproammonium bath to which silver nitrate has been adeed, and then in a coagulation bath; it is then subjected to the action of hydrogen sulfide and passed into an electrolytic bath. Such a process is not fully satisfactory because the numerous processing steps required make it an expensive process.

An object of the present invention is to provide a simple and economical method for making articles of synthetic polymers uniform conductors of electricity without their mechanical properties being extensively modified.

The objects of the invention are accomplished by providing a method of adhering metal compounds to articles of synthetic polymers wherein the articles are subjected to the action of hydrogen sulfide under pressure or to the action of an aqueous solution of thioacetamide or thiourea, and then subjected to the action of an aqueous solution of a metal salt.

The invention also concerns the articles obtained by this method.

Articles which are capable of being treated by the method of the invention may be present in very different forms, such as fibers, threads, films or other shaped articles, namely knitted or woven fabrics or nonwoven polymeric materials. As polymeric materials which are particularly well suited for the carrying out of the method of the invention, mention may be made preferably of the synthetic polymers such as polyamides (polyhexamethylene adipamide, polycaproamide), the polyesters (ethylene polyterephthalate) and the thermostable polymers of the polyamide-imide type, and aromatic polyamides.

The application of these sulfur compounds to the article is effected by conventional impregnation, by immersion at ordinary temperature in an aqueous solution of the sulfur compound. In the particular case of hydrogen sulfide, the impregnation is effected at a pressure slightly above atmospheric in gaseous or liquid phase. Preferably, the pressure is from about 2 to 5 kg. per square centimeter, for instance in an autoclave which is brought to saturated steam pressure. Positive gage pressures are not required when an aqueous solution of a sulfur compound is used. Solutions containing from about 3% to 10% by weight of the sulfur compound are preferably used.

The duration of the impregnation varies as a function of the nature of the sulfur compound used, the nature of the polymer of which the article is formed, and the amount of conductivity which it is desired to obtain. In general, this time varies from ¾ of an hour to 2 hours. Good results are obtained with an average time of one hour.

The article which has thus been impregnated in the liquid phase has the liquid removed in conventional manner, for instance in a centrifuge, in order to eliminate the excess solution remaining on the surface of the article. In case of treatment by gaseous hydrogen sulfide, this question of inking is needless.

The metal salts used in the method of the invention are those which react with the sulfur compounds to give stable combinations which adhere well to the article and withstand the customary conditions of its use and maintenance. For example, the water soluble salts of copper (cuprous or cupric), silver, tin, lead and mercury, may be used. The cuprous salts may be made soluble in water by preparing an aqueous ammonium solution thereof. The metallic salts most frequently used are the copper chlorides (cuprous chloride being possibly in ammoniacal medium), copper sulfate and nitrate, mercuric chloride, silver nitrate, and the like. Silver nitrate is preferably used with thiourea and thioacetamide. Generally, solutions containing from about 3% to about 10% metal salt by weight may be used.

The application of the metal salts to the article is effected by impregnation. In general, in order to simplify the process, it is carried out in a manner similar to that employed for the sulfur compound, that is to say, the article is immersed in an aqueous solution of the metal compound under substantially identical conditions of temperature and time. After the impregnation has been completed, the article is then rinsed with water, centrifuged and dried by any suitable known means.

The article treated in accordance with the method of the invention has a deposit of metal product resulting from the combination between the sulfur compound and the metal salt, this deposit taking place uniformly on the surface of the article and/or within it, the amount of the penetration being a function of the nature of the polymer of which the article is formed, the nature of the reagents and finally the conditions of the treatment. The deposit of metal product imparts upon the article a sufficient electrical conductivity substantially to improve its antistatic properties and to permit its use as a heating surface.

It is well known that the antistatic properties of a product are related to the quality of its conductivity. By utilizing the properties of conductivity obtained in accordance with the process of the invention, it is possible to improve the antistatic properties of articles of synthetic polymers such as floor coverings (rugs, carpets), wall coverings, articles of clothing and the like. This improvement in the antistatic properties is very resistant to wear and to the different washing and dry cleaning treatments due to the good adherence of the metal product to its support.

When the improvement in the electrical conductivity is sufficient, the articles may be used in interesting fashion as a heating surface and may be suitable, for instance, for heating wall coverings, heating clothes, articles for industrial heating and the like. In order to obtain the heating, it is sufficient to connect the article by any known means to a source of electricity. The method of the invention has the advantage of permitting a uniform heating at all points of the article since the conductive metal product is arranged regularly on the support.

The following examples are given by way of illustration and not of limitation of the invention.

EXAMPLE 1

A thread of polyhexamethylene adipamide of a size of 235 dtex (210 den)/34 ends is introduced into an autoclave fed with hydrogen sulfide under a pressure of 5 kg at a temperature of 22°C. After treatment for one hour, it is immersed into a 3% aqueous copper sulfate solution for 1 hour at 22°C, rinsed with running water and dried in an oven at 60°C for 30 minutes.

The mechanical properties of the treated thread are measured on a dynamometer and compared with those of an identical control thread which has not been treated; the results are given in the following table;

| Thread | Load | Elongation |
|---|---|---|
| Control thread | 1500 g | 18% |
| Treated thread | 1500 g | 18% |

It is seen that the treatment in accordance with the invention does not affect the mechanical properties of the articles treated.

EXAMPLE 2

A fabric weighing 60 g/m2 formed in warp and filling of ethylene polyterephthalate yarns of 72 dtex (65 den)/33 ends is introduced into an autoclave fed with hydrogen sulfide under a pressure of 5 kg at a temperature of 22°C. After treatment for 1 hour, the fabric is immersed in a 4% aqueous silver nitrate solution for 1 hour at 22°C, then rinsed for 30 minutes with running water and dried in an oven at 60°C for 30 minutes.

The potential assumed by the fabric as well as its half-discharge time at 22°C in an atmosphere containing 47% relative humidity is measured by means of a Lhomargy electrostatimeter (Model ES 01) in accordance with an induction method, the inductor electrode being brought to a potential of 4100 volts. The electrostatimeter makes it possible to determine the potential assumed by the fabric as well as the time necessary in order for this potential to decrease by half (half-discharge time). In accordance with the principle, the greater the conductivity of the fabric, the lower the potential and the shorter the half-discharge time.

The same measurements were carried out on the fabric after 20 successive washings effected under the following conditions: the fabric is immersed for 30 minutes in an aqueous bath, heated to 60°C, maintained in agitation and containing 5 g/l of soap and 2 g/l of sodium carbonate, in a ratio of 1:50, whereupon the fabric is rinsed for 5 minutes with running water and then dried in an oven at 60°C.

The results obtained, compared with those of a control fabric which is identical but did not undergo the treatment of the invention, are indicated in the following table:

| Fabric | Potential (volts) | Half-discharge time in seconds |
|---|---|---|
| Control fabric | 750 | 436 |
| Treated fabric | 0 | |
| Treated after 20 washings | 260 | 1 |

-continued

EXAMPLE 3

A fabric weighing 60 g/m2, formed in the warp and filling of polyhexamethylene adipamide yarns of 78 dtex(70 den)/23 ends, is treated as in Example 2, except that the aqueous silver nitrate solution is replaced by a saturated ammoniacal cuprous chloride solution.

The results obtained as in Example 2, and also compared with a control fabric which is identical but not treated are indicated in the following table:

| Fabric | Potential (volts) | Half-discharge time in seconds |
|---|---|---|
| Control fabric | 720 | 79 |
| Treated fabric | 0 | |
| Treated fabric after 20 washings | 300 | 12 |

EXAMPLE 4

A fabric identical to that described in Example 3 is immersed for one hour at 22°C and atmospheric pressure in an 8% aqueous thioacetamide solution, and then centrifuged in a centrifuge rotating at 1500 rpm for 10 minutes. The fabric is then immersed in a 4% aqueous silver nitrate solution, rinsed in running water for 30 minutes, and then dried in an oven at 60°C for 30 minutes.

The results obtained, as in the preceding examples, are indicated in the following table:

| Fabric | Potential (volts) | Half-discharge time in seconds |
|---|---|---|
| Control fabric | 720 | 79 |
| Treated fabric | 0 | |
| Treated fabric after 20 washings | 160 | 42 |

EXAMPLE 5

A nonwoven fabric of the spun-bonded type, formed of continuous filaments of polyhexamethylene adipamide of 22 dtex (20 den) is introduced into an autoclave fed with hydrogen sulfide under a pressure of 5 kg at a temperature of 22°C. AFter 1 hour of treatment, the fabric is immersed for 1 hour at 22°C in a 3% aqueous copper sulfate solution, then rinsed under running water for 30 minutes and dried in the oven at 100°C for 30 minutes.

Two electrodes spaced 35 cm apart are connected to this fabric under a voltage of 11 volts. It was found that the power dissipated is about 300 watts/m2.

EXAMPLE 6

A fabric weighing 75 g/m2, formed in the warp and filling of a polyhexamethylene adipamide yarn of 235 detex(210 den)/34 ends is treated as in Example 5. Two electrodes spaced 15 cm apart are connected under a voltage of 11 volts to the fabric. The power developed is about 100 watts/m2.

EXAMPLE 7

A fabric similar to the one described in Example 3 is treated as in Example 4, except for replacing the 8% thioacetamide solution with an 8% thiourea solution. The concentration of the silver nitrate solution is 3%. Test results are listed in the following table:

| Fabric | Potential (volts) | Half-discharge time in seconds |
|---|---|---|
| Untreated fabric | 720 | 79 |
| Treated fabric | 0 | |

EXAMPLE 8

A fabric similar to the one described in Example 3 is treated as in Example 2, except for replacing the treatment with a 4% aqueous silver nitrate solution with a 5% lead nitrate aqueous solution for three-quarters of an hour at 50°C. Test results are listed in the following table:

| Fabric | Potential (volts) | Half-discharge time in seconds |
|---|---|---|
| Untreated fabric | 720 | 79 |
| Treated fabric | 0 | |

EXAMPLE 9

A fabric similar to the one of Example 3 is treated as in Example 2, except for replacing the treatment with a 4% silver nitrate solution with an aqueous 5% stannous sulfate solution for three-quarters of an hour at 50°C. Test results are listed in the following table:

| Fabric | Potential (volts) | Half-discharge time in seconds |
|---|---|---|
| Untreated fabric | 720 | 79 |
| Treated fabric | 70 | 1 |

EXAMPLE 10

A fabric similar to the one described in Example 2 is treated as in Example 2, except for replacing the treatment with a 4% silver nitrate solution by a treatment with a 5% aqueous lead nitrate solution for three-quarters of an hour at 50°C. Test results are listed in the following table:

| Fabric | Potential (volts) | Half-discharge time in seconds |
|---|---|---|
| Untreated fabric | 750 | 436 |
| Treated fabric | 0 | |

EXAMPLE 11

A fabric similar to the one described in Example 2 is treated as in Example 2, except for replacing the treatment with a 4% silver nitrate solution by a treatment with a 5% stannous sulfate solution for three-quarters of an hour at 50°C. Test results are listed in the following table:

| Fabric | Potential (volts) | Half-discharge time in seconds |
|---|---|---|
| Untreated fabric | 750 | 436 |
| Treated fabric | 450 | 2 |

Although the invention has been described in detail for the purpose of illustration, it is to be understood that such detail is solely for that purpose and that variations can be made therein by those skilled in the art without departing from the spirit and scope of the invention except as it may be limited by the claims.

What I claim is:

1. A method for improving the antistatic properties of a fiber selected from the group consisting of polyamide, polyester, polyamide-imide and aromatic polyamide fibers, which comprises treating the fiber with hydrogen sulfide under a pressure slightly over atmospheric or with an aqueous bath of thioacetamide or thiourea and thereafter impregnating the resulting product by immersing it in an aqueous solution containing a water soluble salt of copper, silver, tin, lead or mercury which will react with the said sulfur compound and form an electrically conductive deposit on the said fiber.

2. The method of claim 1 wherein the metallic salt is a chloride, nitrate or sulfate of copper, silver, tin, lead or mercury.

3. The process of claim 1 wherein the said pressure is within the range of about 2 to 5 kilograms per square centimeter.

4. A conductive fabric made from fibers obtained by the process of Claim 1 having a continuous, regular and uniform coating of a metallic compound.

5. A method of attaching a metallic compound to a fiber selected from the group consisting of polyamide, polyester, polyamide-imide and aromatic polyamide fibers, which comprises treating the fiber, for about 45 minutes to about 2 hours, at ambient temperature or above, with hydrogen sulfide under a pressure between 2 to 5 kg. per square centimeter or with an aqueous bath of thioacetamide or thiourea, with a concentration of about 3% to about 10% by weight, and exposing the resulting product for about 45 minutes to about 2 hours, at ambient temperature or above and at atmospheric pressure to the action of an aqueous solution of a silver, copper, lead, tin or mercury salt with a concentration of about 3% to about 10% by weight.

6. The method of claim 5 wherein the fiber is subjected to the action of an aqueous solution of thioacetamide or thiourea at atmospheric pressure.

7. The method of claim 5 wherein the silver, copper, lead, tin or mercury salt is a chloride, a nitrate or a sulfate.

* * * * *